US006036074A

United States Patent [19]

Manabe

[11] Patent Number: 6,036,074

[45] Date of Patent: Mar. 14, 2000

[54] STAPLE CLINCHING MECHANISM IN STAPLER

[75] Inventor: Katsunori Manabe, Tokyo, Japan

[73] Assignee: Max Co., Ltd., Tokyo, Japan

[21] Appl. No.: 09/159,764

[22] Filed: Sep. 24, 1998

[30] Foreign Application Priority Data

Sep. 24, 1997 [JP] Japan ..... 9-276415

[51] Int. Cl.[7] ..... B25C 5/02

[52] U.S. Cl. ..... 227/155; 227/131

[58] Field of Search ..... 227/155, 131, 227/79, 82, 83, 87, 154

[56] References Cited

U.S. PATENT DOCUMENTS

| | | | |
|---|---|---|---|
| 4,378,085 | 3/1983 | McVeigh | 227/79 |
| 4,593,947 | 6/1986 | Hagemann | 227/155 |
| 4,844,319 | 7/1989 | Kurosawa | 227/155 |
| 5,029,745 | 7/1991 | Akizawa et al. | 227/131 |
| 5,413,266 | 5/1995 | Jairam | 227/155 |
| 5,791,543 | 8/1998 | Udagawa et al. | 227/155 |

FOREIGN PATENT DOCUMENTS

| | | |
|---|---|---|
| 0322906A2 | 7/1989 | European Pat. Off. . |
| 0838310A2 | 4/1998 | European Pat. Off. . |
| 10-128683A | 5/1998 | Japan . |
| WO97/31758 | 9/1997 | WIPO . |

*Primary Examiner*—Scott A. Smith
*Attorney, Agent, or Firm*—Morgan, Lewis & Bockius LLP

[57] ABSTRACT

In a staple clinching mechanism in a stapler wherein legs of a staple driven in by a driving mechanism are bent in a first direction after the legs of the staple are passed through stacked work sheets, the staple clinching mechanism includes: a pair of movable clinchers; and a pair of curved bend guiding surfaces, for guiding bending the legs of the staple while the movable clinchers are bending the legs of the staple, wherein one of the bend guiding surfaces is inclined in a second direction perpendicular to the first direction.

4 Claims, 7 Drawing Sheets

STAPLE CLINCHING MECHANISM IN STAPLER

BACKGROUND OF THE INVENTION

The present invention relates to a staple clinching mechanism for bending the legs of a staple driven by the driver of a stapler in a clincher portion after the legs thereof are passed through sheets of paper.

Staplers are used for binding sheets of paper by bending the legs of U-shaped staples substantially to right angles after the staples are driven into and passed through the sheets of paper. Since the legs of such a staple are normally bent so that the pointed ends of the legs are directed closer to each other, the legs may collide and interfere with each other, thus resulting in bending inappropriately.

In order to obviate the aforesaid inconvenience, a heretofore known method is, as shown in FIG. 11, to place the boundary 21 between bend guiding surfaces 20*a*, 20*b* on either side of a clincher portion 20 in a position deviating toward one leg-bending surface 20*a*. With the clincher portion like this, the legs 22 of a staple are brought into contact with the respective bend guiding surfaces 20*a*, 20*b* of the clincher portion after the legs are passed through sheets of paper and the leading ends of the legs are increasingly curled while they are being guided inward. Since the boundary of the clincher portion is deviated to one side, the deviation causes the leading end of the leg 22 on the left-hand side in FIG. 11 to be rapidly curled, whereas the leg 22 on the right-hand side is curled after some delay. Consequently, the leading end of the leg 22 that has been bent after some delay is so formed as to hold tightly to itself what has been bent previously, whereby the legs are prevented from interfering from each other.

However, even the aforesaid clinch mechanism has not succeeded in thoroughly preventing the leading ends of the legs from interfering with each other, thus allowing the legs to be bent inappropriately.

SUMMARY OF THE INVENTION

An object of the present invention intended to solve the foregoing problems is to provide a staple clinching mechanism to a stapler so that both legs of a staple are prevented from interfering with each other when the legs thereof are bent.

In order to solve the foregoing problem, a staple clinching mechanism in a stapler wherein legs of a staple driven in by a driving mechanism are bent in a first direction after the legs of the staple are passed through stacked work sheets, comprising: a pair of movable clinchers; and a pair of curved bend guiding surfaces, for guiding bending the legs ot the staple while the movable clinchers are bending the legs of the staple, wherein one of the bend guiding surfaces is inclined in a second direction perpendicular to the first direction.

Futhermore, in the staple clinching mechanism described above, a boundary between both the bend guiding surfaces is set to deviate toward one of the bend guiding surfaces.

DETAILED DESCRIPTION OF PREFERRED EMBODIMENTS

Figure 1:
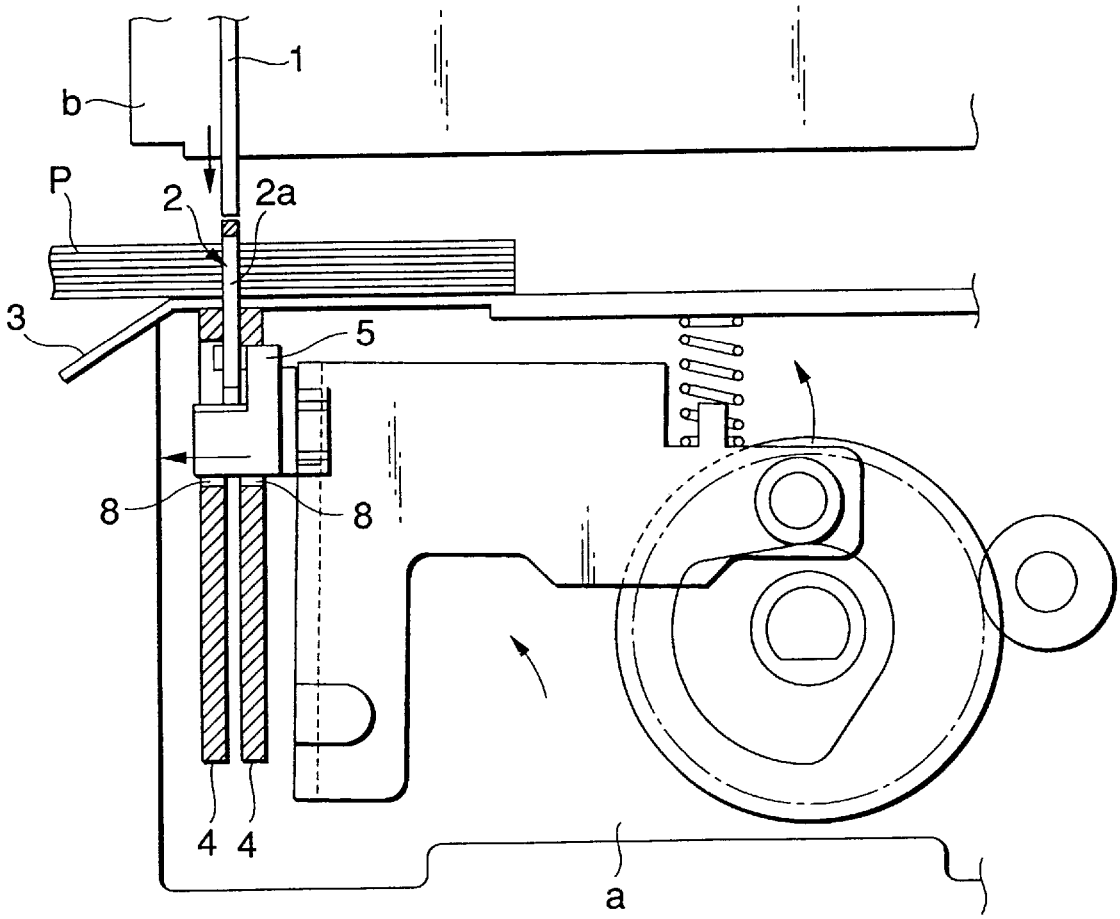
FIG. 1 is a vertical sectional view showing the construction of the principal part of an electric stapler according to an embodiment of the present invention.

FIG. 1 shows an electric stapler according to an embodiment of the present invention.

The electric stapler has a base a and a magazine b mounted thereon. This electric stapler is used for driving a driver 1 by means of an electric motor and a driving mechanism (which are not shown) in order to pass a staple 2 through a material P (stacked work sheets, for instance, papers) to be bound on a binding stand 3 and when the legs 2*a* of the staple 2 are driven in until the tips of the legs passes through the material P on the binding stand 3 and projects downward from the underside of the material, each of the tips thereof is arranged so that it is inserted in between two sheets of longitudinal clincher guides 4 disposed in parallel to each other with a predetermined gap therebetween. A columnar force-cutting cutter 5 for cutting off the excess part of each leg 2*a* of the staple 2 and a moving clincher 6 (see FIG. 2) installed on both sides of the cutter 5 are disposed inside the gap between the clincher guides 4. The cutter 5 also serves as a guiding piece for guiding legs, as described later. Part of each leg 2*a* of the staple 2 driven in by the driver 1 is cut off by the force-cutting cutter 5 after the legs are passed through the material to be bound and bent by the moving clincher 6.

The force-cutting cutter 5 is formed at the front end of a driving link 7 in such a way as to move in and out of cutting holes 8 formed in the respective clincher guides 4. When the leading ends of the legs 2*a* of the staple 2 passed through the material P are too long, the force-cutting cutter 5 is moved forward and by passing the force-cutting cutter 5 through the cutting holes 8 of the respective clincher guides 4, the projecting leading ends of the legs 2*a* of the staple 2 in the cutting holes 8 are cut off by force-cutting with the upper peripheral edge of the force-cutting cutter 5.

Figure 3:
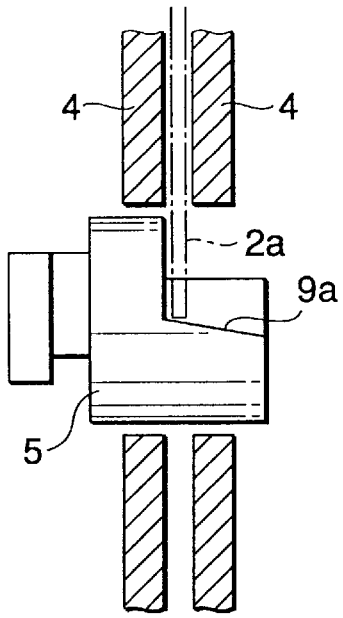
FIG. 3 is a side view of a force-cutting cutter and its periphery.
Figure 4:
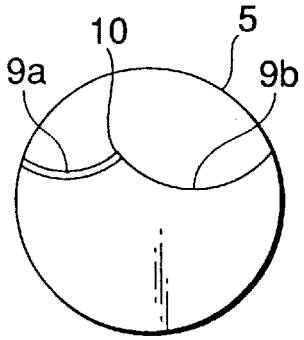
FIG. 4 is an elevational view of the force-cutting cutter.
Figure 5:
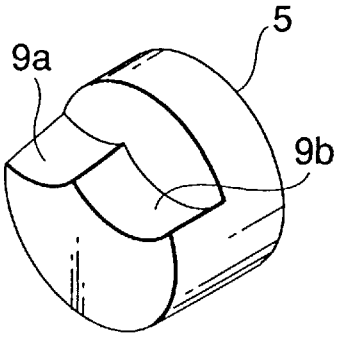
FIG. 5 is a perspective view of the force-cutting cutter.

A clincher portion 9 is formed in the lower portion of the edge face 5*a* of the cutter 5. Furthermore, the clincher portion 9 is, as shown in FIGS. 3 to 5, formed with a pair of laterally-disposed bend guiding surfaces 9*a*, 9*b* for receiving the respective legs 2*a* of the staple 2 in order to guide their bends. The bend guiding surfaces 9*a*, 9*b* are curved and the curving degrees of the bend guiding surfaces 9*a*, 9*b* on either side are set different from each other. Moreover, the boundary 10 between the bend guiding surfaces 9*a*, 9*b* on either side is arranged in a way deviating from the center of the force-cutting cutter 5 toward one bend-guiding surface 9*a*.

The bend guiding surface 9*a* on the left-hand side of FIG. 3 is inclined in a direction perpendicular to the leg guiding direction; more specifically, the surface gradually becomes lower as the distance from the edge face 5*a* of the cutter 5 increases.

Figure 2:
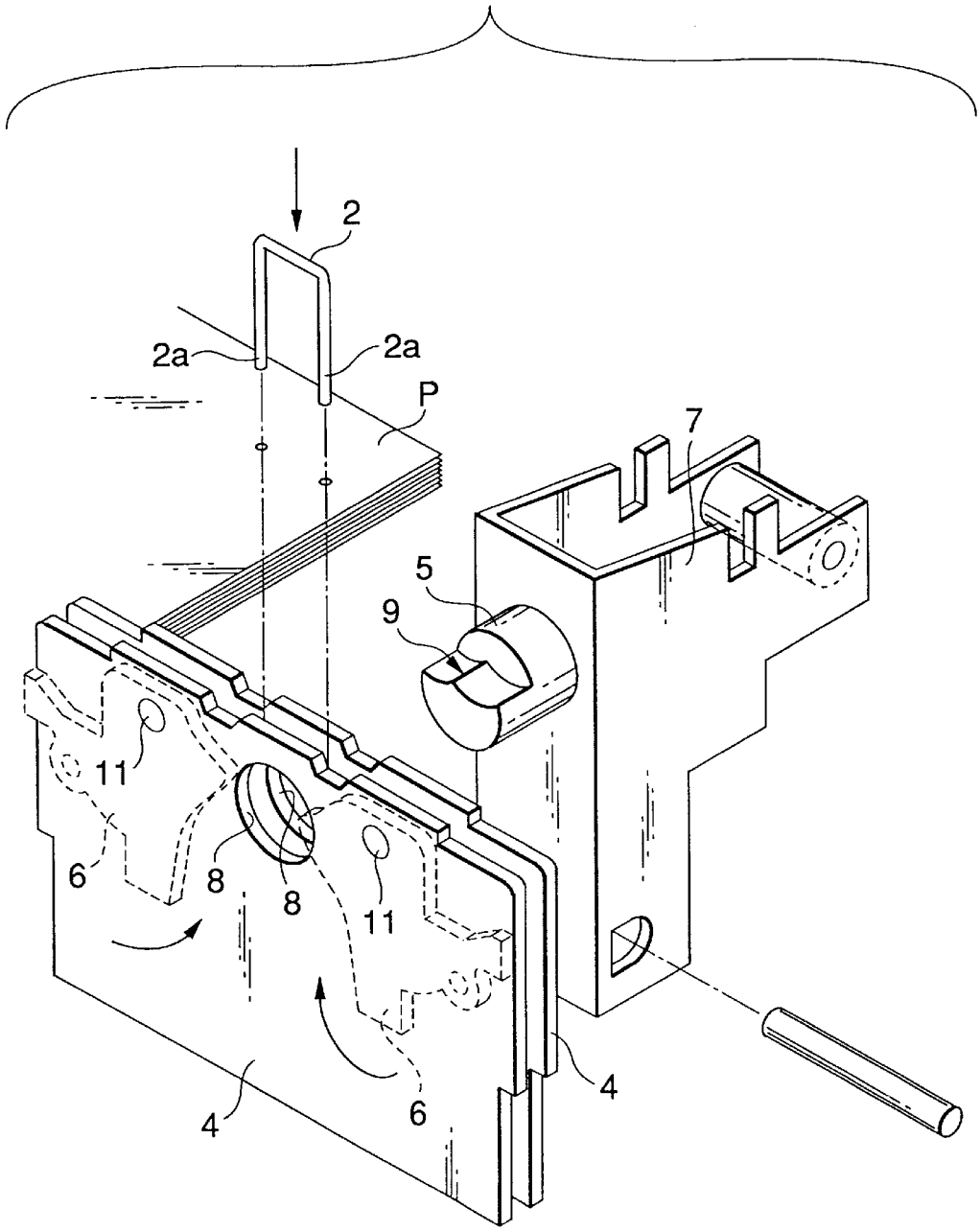
FIG. 2 is a perspective view showing the operation of cutting a staple by means of the aforesaid electric stapler and the principal part of a bend.
Figure 6:
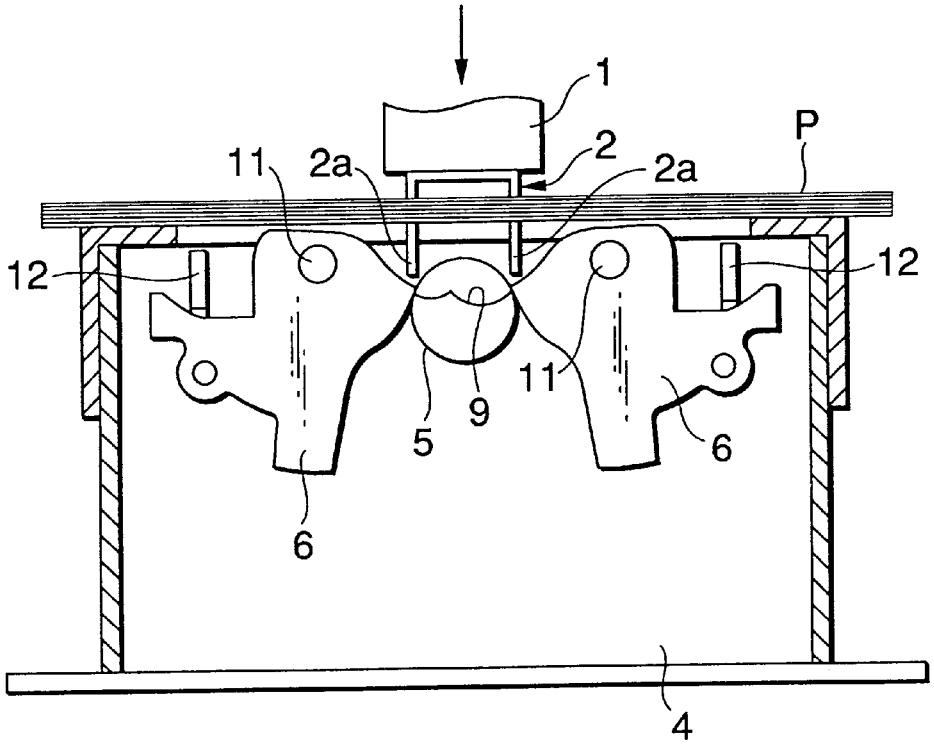
FIG. 6 is an elevational view of the whole clinch mechanism.
Figure 7A:
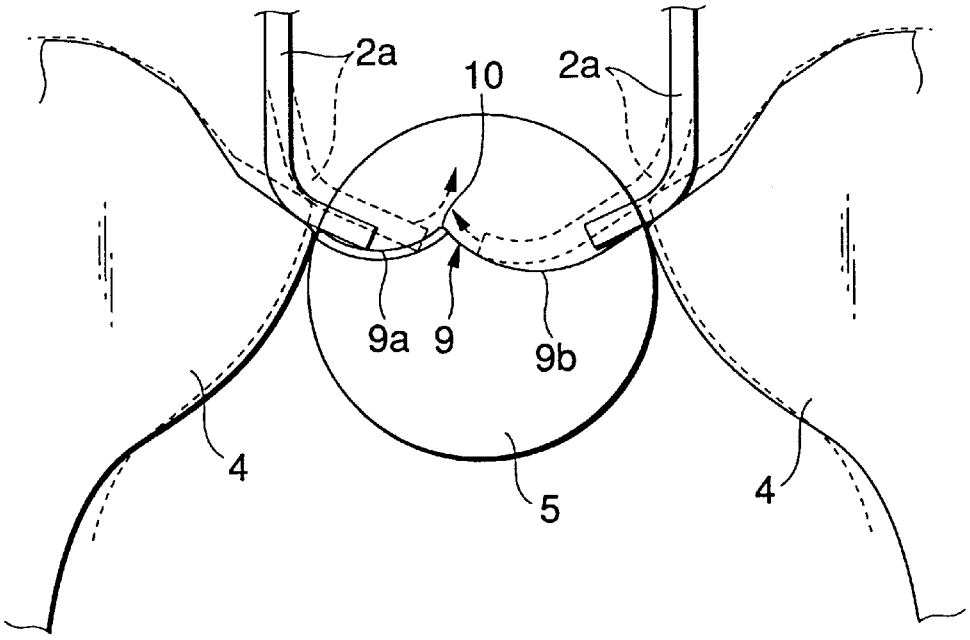
FIGS. 7(*a*) and 7(*b*) are diagrams illustrating the operating mode of the clinch mechanism.
Figure 7B:
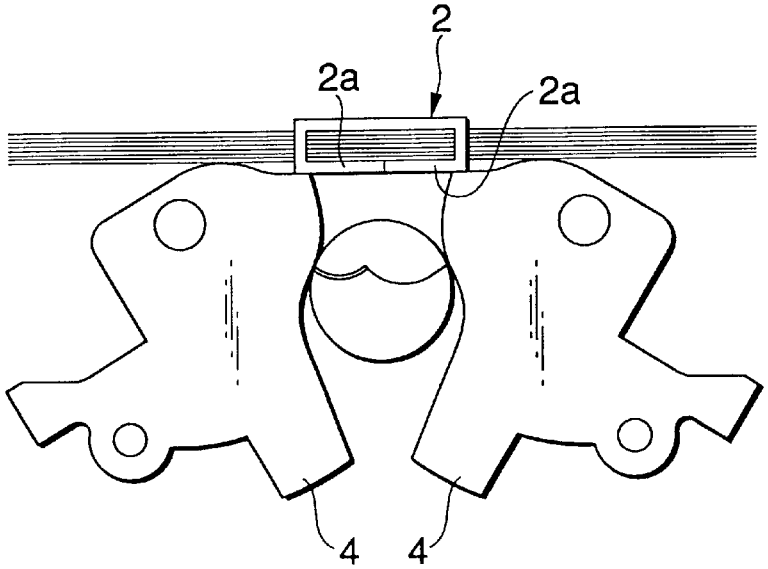

As shown in FIGS. 2 and 6, the moving clinchers 6 are mounted pivotally on support shafts 11 provided to the respective clincher guides 4 and used for receiving the legs 2*a* of the staple 2 passed through the material P first and subjecting the staple 2 to preliminary bending and then pivoted between a first position (the position shown in FIG. 7(*a*)) where the legs 2*a* of the staple 2 are introduced to the clincher portion 9 and a second position (what is shown in FIG. 7(*b*)) where the legs 2*a* of the staple 2 bent in the clincher portion 9 are forced to bend toward the material P and pressed against the underside of the material P.

The description of a mechanism for operating the force-cutting cutter 5 and the moving clinchers 6 will be omitted as the mechanism disclosed in FIGS. 1, 5 and the like in Unexamined Japanese Patent Application Publication No. Hei. 10-128683 or similar thereto.

Incidentally, the clincher portion 9 is formed so that it stays in between the two sheets of clincher guides 4 when the force-cutting cutter 5 is moved back after it has cut off part of each leg of the staple 2.

Moreover, operating timing is so controlled as to make the moving clinchers 6 operate when the force-cutting cutter 5 operates to cut off part of each leg 2*a* of the staple 2 after the driver 1 reaches to the lowest point.

With the arrangement above, the legs 2*a* of the staple 2 passed through the material P are inserted in between the clincher guides 4 by the driver 1 as shown in FIG. 6 and the tips of the legs are brought into contact with the inclined surfaces of the respective moving clinchers 6 placed in the first position, guided and curved inward along the respective surfaces and subjected to the preliminary bending. Although the force-cutting cutter 5 is subsequently operated then, any part of each leg 2*a* is not cut off if the length of the excessive part thereof passed through the material P is short. Then the clinch mechanism operates to force driving levers 12, which are forced up as shown in FIG. 7(*a*). The leading ends of the rear ends of the moving clinchers 6 are pivoted upward around the respective support shafts 11, so that the legs 2*a* of the staple 2 are increasingly forced to bend. Thus, the leading ends of the legs 2*a* of the staple 2 are each guided slidably along the bend guiding surfaces 9*a*, 9*b* formed in the clincher portion 9 in the lower portion of the edge face 5*a* of the cutter 5 while the moving clinchers 6 are moving to the second position and part of each leg 2*a* passed through the material P is totally curled before being bent finally as shown in FIG. 7(*b*).

Figure 8:
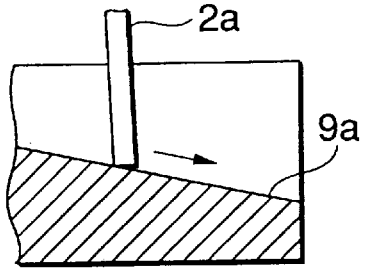
FIG. 8 is a diagram illustrating a guiding mode by means of one folding guide surface.
Figure 9:
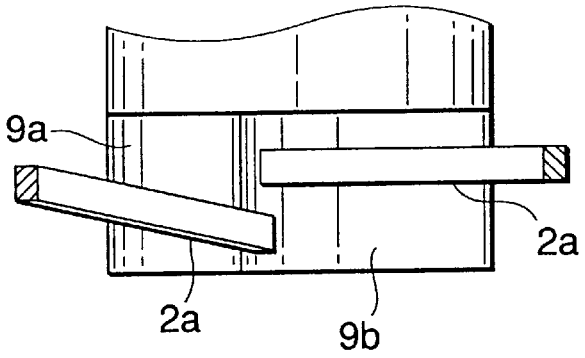
FIG. 9 is a diagram illustrating a staple-leg bending mode.
Figure 10:
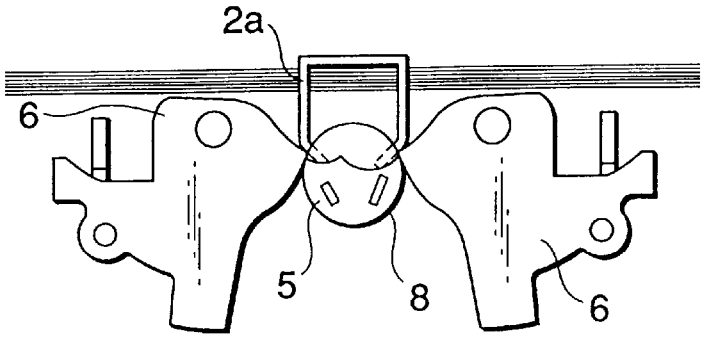
FIG. 10 is a diagram illustrating a staple cutting mode.
Figure 11:
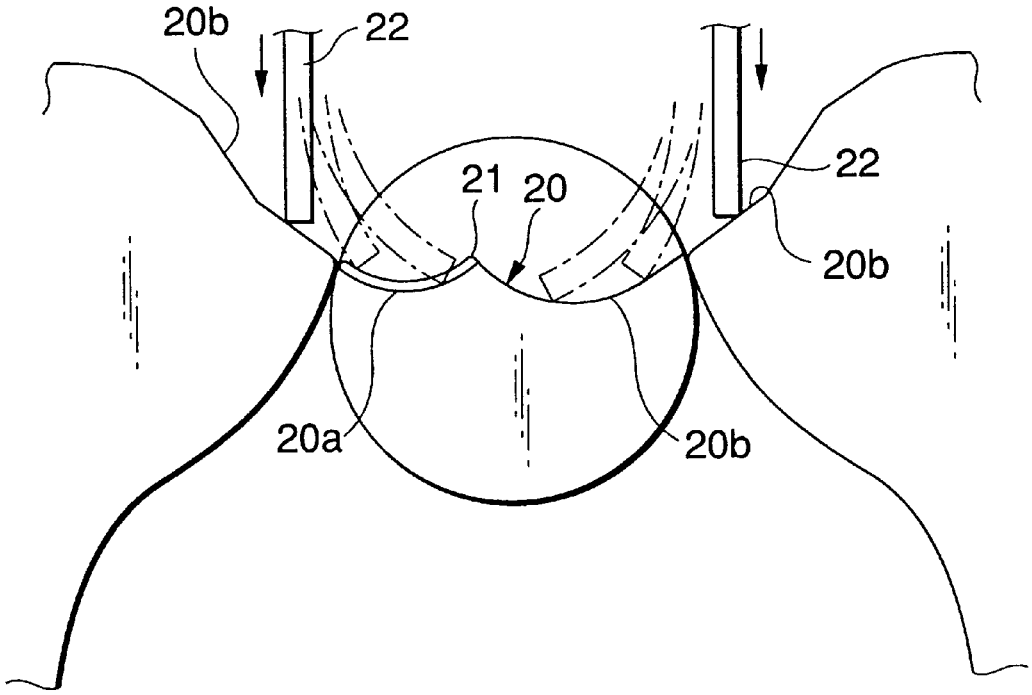
FIG. 11 is a diagram illustrating a leg bending mode by means of a clinch mechanism in a conventional staple.
Figure 12:
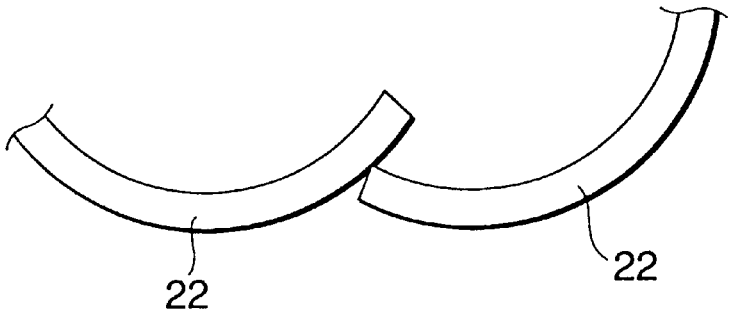
FIG. 12 is a diagram illustrating a state of the staple leg bent by means of the clinch mechanism in FIG. 11.

Since it has been so arranged that the bend guiding surfaces 9*a*, 9*b* of the clincher portion 9 are curved and that the boundary 10 between both bend guiding surfaces 9*a*, 9*b* is set to deviate from the center of the force-cutting cutter 5 toward the one bend guiding surface 9*a*, the leg 2*a* of the staple 2 guided by the bend guiding surface 9*a* on the left-hand side of FIG. 7(*a*) is bent quicker than the leg 2*a* on the right-hand side. As the bend guiding surface 9*a* on the left-hand side is inclined in a direction perpendicular to the leg guiding direction, moreover, the left-hand leading end of the leg 2*a* of the staple 2 is also bent along the slope of the staple guiding surface 9*a* as shown by an arrow of FIG. 8. Consequently, the lateral legs 2*a* are prevented from interfering with each other when they cross each other, so that excellent binding is accomplishable.

In a case where the legs 2*a* passed through a thin material P to be bound (the number of sheets is small) are too long, on the other hand, the excessive part of each leg projects from the cutting holes 8 and exposes after the legs are each brought into contact with the moving clinchers 6 and then subjected to the preliminary bending along the bend guiding surfaces 9*a*, 9*b*, so that part of each leg is cut off when the force-cutting cutter 5 is moved forward as set forth above. Subsequently, the clinch mechanism is actuated so that the legs 2*a* are bent by the respective moving clinchers 6. Therefore, both legs 2*a* never interfere with each other when they cross each other since the one bend guiding surface 9*a* is inclined in a direction perpendicular to the leg guiding direction.

Providing the boundary 10 between both the aforesaid bend guiding surfaces in a position deviating toward the one bend guiding surface has the effect of making both legs 2*a* hardly interfere with each other because of the aforesaid time difference in bending both legs 2*a*. However, the boundary 10 may be-formed at the center of the force-cutting cutter 5 as the one leg 2*a* is bent in a direction perpendicular to the leg guiding direction along the bend guiding surface 9*a*.

What is claimed is:

1. A staple clinching mechanism in a stapler wherein legs of a staple driven in by a driving mechanism are bent in a first direction after the legs of the staple are passed through stacked work sheets, comprising:

a pair of pivotable clinchers; and a guiding piece including a pair of curved bend guiding surfaces, for guiding bending the legs of the staple, wherein one of said bend guiding surfaces is inclined in a second direction perpendicular to the first direction.

2. The staple clinching mechanism as claimed in claim 1, wherein a boundary between both said bend guiding surfaces is set to deviate toward one of said bend guiding surfaces.

3. The staple clinching mechanism as claimed in claim 1, wherein said guiding piece has a column shape, except for said bend guiding surfaces.

4. The staple clinching mechanism as claimed in claim 1, wherein said bend guiding surfaces are curved such that each of said bend guiding surface is smoothly continued from respective one of said clinchers when said clinchers are in their initial positions.

* * * * *